United States Patent [19]

Meyer et al.

[11] Patent Number: 4,640,277

[45] Date of Patent: Feb. 3, 1987

[54] SELF-CONTAINED BREATHING APPARATUS

[75] Inventors: Steven D. Meyer, Fort Worth; Peter B. Raven, Irving, both of Tex.

[73] Assignee: Texas College of Osteopathic Medicine, Fort Worth, Tex.

[21] Appl. No.: 611,507

[22] Filed: May 17, 1984

[51] Int. Cl.[4] ..... A62B 7/04

[52] U.S. Cl. ..... 128/204.23; 128/204.26; 128/205.24

[58] Field of Search ..... 128/204.21, 204.22, 128/204.23, 204.24, 204.25, 204.26, 204.28, 205.12, 205.13, 205.24, 207.18, 207.16, 204.27

[56] References Cited

U.S. PATENT DOCUMENTS

| | | | |
|---|---|---|---|
| 1,695,537 | 12/1928 | Drager | 128/204.28 |
| 2,593,046 | 4/1952 | McKee | 128/204.27 |
| 2,830,580 | 4/1958 | Saklad et al. | 128/204.23 |
| 2,908,270 | 10/1959 | Stanton | 128/204.27 |
| 3,794,021 | 2/1974 | Lambertsen | 128/204.28 |
| 3,985,131 | 10/1976 | Buck et al. | 128/205.13 |
| 4,121,579 | 10/1978 | Bird | 128/204.25 |
| 4,378,011 | 3/1983 | Warncke | 128/204.26 |
| 4,401,115 | 8/1983 | Monnier | 128/204.23 |
| 4,484,578 | 11/1984 | Durkan | 128/204.24 |

*Primary Examiner*—Henry J. Recla

*Attorney, Agent, or Firm*—Reed Smith Shaw & McClay

[57] ABSTRACT

This invention provides a self-contained user-actuated breathing device of the type used by industry and firefighters to protect against toxic atmospheres, which includes means for reducing user respiratory fatigue during periods of heavy physical exertion or stress, while maintaining facepiece pressure in a preselected narrow range of positive pressures relative to atmospheric to protect the user from ingress of toxic outside atmospheres. The invention includes a feedback mechanism responsive to facepiece pressure which actuates a supplemental second inlet air flow path to the facepiece during periods of high user demand. Also provided is a novel nonlinear expiration valve mechanism which is responsive to facepiece pressure to prevent facepiece pressure from exceeding a preselected positive level, thereby minimizing user expiratory fatigue which is commonly associated with such devices.

11 Claims, 6 Drawing Figures

SELF-CONTAINED BREATHING APPARATUS

FIELD OF THE INVENTION

The invention relates to breathing apparatus of the type used in industry and by firefighters to provide protection against toxic atmospheres, particulates and oxygen deficient atmospheres.

DISCUSSION OF THE TECHNICAL PROBLEM

Known self-contained breathing devices generally include a cylinder of compressed purified air, a facepiece, a pressure reducing regulator to reduce air pressure to levels suitable for breathing through a facepiece and a movable diaphragm which controls delivery of air to the facepiece in response to changes in air pressure caused by a user's breathing cycle.

Such devices are portable and user-actuated, in contrast to highly complex hospital-variety mandatory ventilators which are known to be used for the artificial ventilation of pulmonary tracts of patients, such as those described in U.S. Pat. Nos. 4,206,754 and 4,401,115.

Self-contained breathing devices generally operate in a "demand" mode, or in a "pressure-demand" (or positive-pressure) mode. In a demand-type breathing device, when the user inhales, pressure on the breathing gas-side of the diaphragm becomes lower than the ambient pressure on the opposite side of the diaphragm, causing the diaphragm to move inwardly to open an air admission valve which passes breathing air to the facepiece. When the user exhales, pressure on the diaphragm exceeds embient and the air admission valve is closed. At the same time, the increased pressure urges an exhalation valve open to permit exhaled air to pass to atmosphere.

The operation of a pressure-demand breathing device is substantially similar to the operation of the demand breathing device, except a biasing spring is added to the diaphragm to cause air flow to the facepiece to begin before the facepiece pressure goes below ambient, e.g., flow begins at 1 inch (2.5 cm.) $H_2O$ positive pressure at the diaphragm. A second biasing spring is generally added to the exhalation valve to maintain it in a closed position until the selected threshold pressure is exceeded during exhalation.

The pressure-demand breathing device is presently generally preferred because of increased protection which it provides the user. In the demand device, the user must create a slight vacuum in order to initiate air flow, at which time any facepiece-to-face seal leakage will allow outside air into the facepiece to be inhaled. In the pressuredemand device, pressure in the facepiece theoretically will remain positive even at the beginning of the inhalation cycle, thereby causing an outward flow at any facepiece-to-face seal leaks. While the service life of the pressure-demand device might be shortened in the event of a leak, the added measure of protection is clearly to be desired.

Even pressure-demand breathing devices are limited, however, because during periods of heavy physical exertion or stress they place psychophysiological burdens upon the user. During such periods, the design of presently known breathing devices places an increased breathing workload on the user during both the inhalation and exhalation cycles. During inhalation, peak mask pressures become negative relative to atmospheric pressure with only moderate exertion of the user, and may decrease to about −4.0 inches (−10.0 cm.) $H_2O$ during heavy exertion. This places an unnatural physiological stress upon the respiratory system during times of peak negative pressure.

During exhalation, peak pressures during heavy work also become inordinately high, e.g., +5.6 inches (+14.0 cm.) $H_2O$. Because expiration is normally a passive function, respiratory muscles must work unusually hard in the face of high expiratory pressure and the psychic phenomena of dyspnea or claustrophobia may be triggered in the user. It has been recognized that peak inspiratory to expiratory pressure swings within the facepiece in excess of 6.8 inches (17.0 cm.) $H_2O$ exceeds the limit of subjective tolerance in the average user. This limit is regularly exceeded with prior art breathing devices during periods of heavy user demand.

It would be desirable to have a self-contained breathing device of the type discussed above which was not limited during periods of heavy physical exertion or stress.

SUMMARY OF THE INVENTION

The present invention provides a self-contained breathing device of the type used in industry or by firefighters to provide protection to the user from toxic atmospheres, which improves user respiratory comfort and provides increased protection during periods of heavy physical exertion or stress and increased respiratory demands. The breathing device according to the present invention minimizes facepiece pressure variations during high demand respiration to levels which do not produce subjective user discomfort, while at the same time it reduces or eliminates instances in which facepiece pressure decreases to below ambient pressure, thereby protecting against potentially harmful ingress of toxic outside atmosphere into the facepiece. In a preferred embodiment of the invention facepiece pressure is maintained in a narrow range centered about +1 inch (2.5 cm.) $H_2O$ relative to ambient, during the complete respiratory cycle of a user, during periods of both light and heavy physical exertion.

The breathing device of the present invention includes a facepiece which can be worn on the face of a user to isolate the breathing functions of the user from ambient atmosphere, a supply of pressurized breathing air which is supplied to the facepiece in response to the inhalation demand of the user, and a novel air flow regulator between the air supply and facepiece. The air flow regulator according to the present invention includes first and second air flow paths, the first air flow path being hydraulically responsive, e.g., through a diaphragm member, to permit air passage to the facepiece when facepiece pressure decreases to a first preselected level during an inhalation cycle. The second air flow path responds when facepiece pressure decreases to a lower, second preselected level to permit additional or supplemental air passage to the facepiece during periods of high volume demand by the user, e.g., during heavy physical exertion or high stress. Preferably, the second air flow path activates to meet the increased demand before facepiece pressure decreases to lower than ambient pressure, such that a vacuum condition with the facepiece is avoided. Additionally, user inhalatory fatigue is minimized because resistance thereto is reduced by the additional supply of breathing air automatically provided by the second air flow path upon demand of the user.

The present invention also substantially reduces user discomfort and fatigue in expiration during periods of high physical exertion or stress, by including a novel expiration regulator system. In one embodiment, an expiration valve is spring-controlled to hydraulically open to a first extent in direct response to positive facepiece pressures. A feedback facility which is also responsive to facepiece pressures generates a signal when facepiece pressure increases to a preselected positive level to actuate an electromechanical assist mechanism which opens the expiration valve to a second and greater extent to reduce facepiece pressure to below the preselected level. In this manner, user discomfort associated with high expiration resistance may be substantially eliminated. In an alternative embodiment, the expiration valve is controlled by a novel nonlinear spring mechanism which opens the expiration valve to a first extent in the conventional manner, but upon facepiece pressure exceeding a preselected threshold, the spring mechanism opens the expiration valve to a second and greater extent in nonlinear relation to facepiece pressure.

Preferably the breathing device of the present invention includes a pressure sensitive electrical switch mechanism mounted on the facepiece which generates a first signal when facepiece pressure decreases to the second preselected level during inhalation to actuate the second air flow path, and which generates a second signal when facepiece pressure increases to the threshold level during exhalation to actuate the novel expiration regulator system.

DESCRIPTION OF THE PREFERRED EMBODIMENTS

Figure 1:
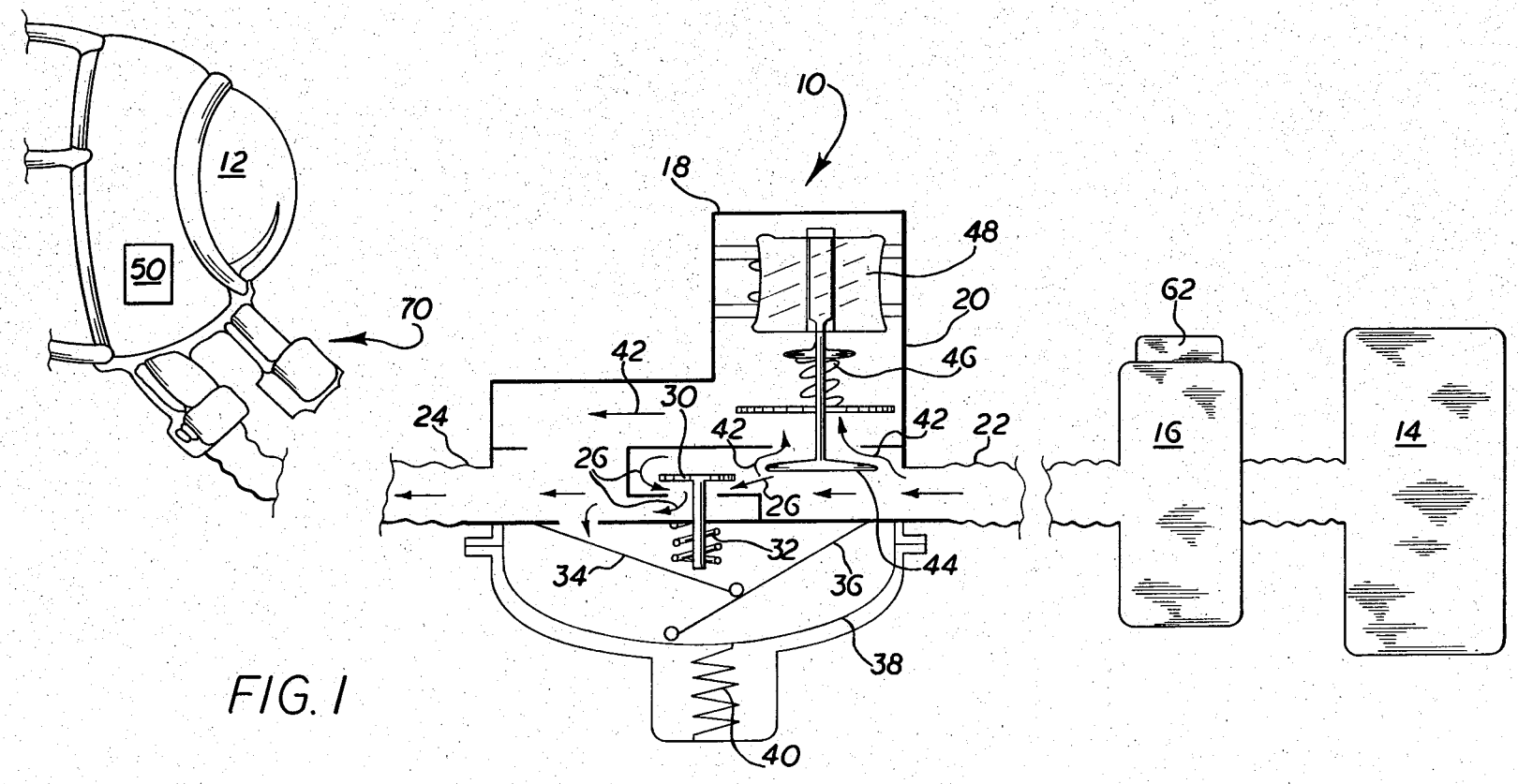
FIG. 1 is a partially schematic view of a self-contained breathing device in accordance with the present invention, with portions removed for purposes of clarity.

The present invention provides an improved self-contained breathing device of the type used by industry and firefighters to protect the user from toxic atmospheres. With reference to FIG. 1, a self-contained breathing device 10 includes a facepiece 12, a supply of pressurized breathing air 14, an intermediate pressure reducing regulator 16, and a inlet air flow regulator 18. Pressure reducing regulator 16 and air supply 14 are well known in the art and require no further description herein.

Inlet air flow regulator 18 consists generally of a housing 20 into which an air line 22 from pressure reducing regulator 16 enters and from which an air line 24 to facepiece 12 exits. (Of course, pressure reducing regulator 16 could also be conveniently included within the same housing as inlet air flow regulator 18 without departing from the teaching of the present invention.) Regulator 18 includes a first air flow path identified by arrows 26, which air flow path 26 is hydraulically directly responsive to the inhalatory demands of the user of facepiece 12 through the cooperation of a first valve member 30, a valve control spring 32, actuating levers 34 and 36, a diaphragm member 38 and a bias spring 40. On its inner surface, diaphragm member 38 is in communication with and is sensitive to the pressure adjacent the inlet end of air line 24, and is thereby responsive to the pressure in facepiece 12. On its outer surface, diaphragm 38 is in communication with atmospheric pressure. In addition, in the embodiment of the invention show in FIG. 1, bias spring 40 is included to act on the outer surface of diaphragm 38 to cause breathing device 10 to function in the "pressure-demand" mode of operation; i.e., facepiece pressure need not decrease to less than atmospheric pressure before diaphragm 38 urges first valve member 30 open at the beginning of an inhalation cycle. The tension of bias spring 40 may be selected to control the facepiece pressure at which first airflow path 26 opens ("a first preselected level"). While this is the preferred mode of operation, the invention is not limited to such an embodiment and bias spring 40 could be eliminated if it were desired to operate in a "demand" mode. In either form of operation, the initiation of an inhalation cycle by the user creates a pressure difference along the surfaces of diaphragm 38 which urges diaphragm 38 inward to open first valve 30. This direct-demand actuation of first valve 30 through hydraulic action is a significant safety and reliability feature of the present invention, the simplicity and directness of the design practically assuring that the user will receive sufficient air flow during periods of light to moderate activity. However, as discussed above, first air flow path 26 may be inadequate to comfortably provide a user with the volume of breathing air required during periods of high physical activity or stress when demand increases dramatically.

With further reference to FIG. 1, inlet air flow regulator 18 according to the present invention also includes at least one second air flow path, identified by arrows 42 in FIG. 1. Second air flow path 42 is adapted to supplement the breating air supplied to facepiece 12 by first air flow path 26 and in a preferred embodiment of the invention is actuated only when the user demand for breathing air is in excess of the amount which can comfortably be supplied by first air flow path 26, as evidenced by a decrease of facepiece pressure to a second preselected level lower than the first preselected level at which the first air flow path 26 is actuated.

Preferably, second air flow path 42 is capable of providing larger volumes of breathing air than first air flow path 26, with less resistance to the respiratory system of the user. Thus, a second valve member 44 larger than first valve member 30 may be conveniently controlled by a valve spring 46 and an electromechanical solenoid member 48. An actuating electrical signal received by solenoid member 48 causes second valve member 44 to open second air flow path 42 to the passage of supplemental breathing air, thereby reducing inspiration resistance. Preferably, the second preselected level of facepiece pressure is selected to be lower than the first preselected level but positive relative to atmospheric pressure. The flow capacity of second air flow path 42 is designed to be sufficient to main facepiece pressure in the positive range even under the highest levels of user demand, thereby substantially improving the protective qualities of the breathing device by eliminating all instances of negative pressure in the facepiece.

Figure 2:
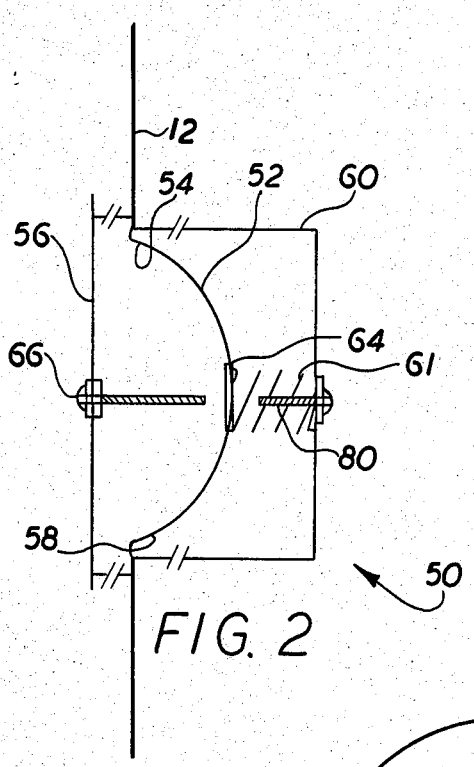
FIG. 2 is an enlarged sectional view of the pressure sensitive feedback mechanism of FIG. 1, with portions removed for purposes of clarity.

With reference also to FIG. 2, a preferred pressure sensitive feedback mechanism 50 is shown mounted to and forming a portion of facepiece 12. Mechanism 50 includes an air impervious flexible diaphragm 52 communicating on its inside surface 54 with the interior of facepiece 12 through screen 56, and on its outside surface 58 with ambient atmosphere through screen 60. A light weight spring 61 may be provided between diaphragm 52 and one or both of the screens to provide stability to mechanism 50. A source of electrical power 62, e.g., a dry cell battery, is mounted on breathing device 10 in any convenient location. An electrical circuit is provided between power source 62, solenoid member 48, an electrical contact member 64 which is secured to diaphragm 52, and an adjustable contact 66 which is secured to screen 56. During an inhalation cycle, if facepiece pressure decreases to a level where contact member 64 is urged into contact with adjustable contact 66, an electrical circuit is closed to activate solenoid member 48 to open second air flow path 42. If facepiece pressure increases to a level above the second preselected level upon the opening of second air flow path 42 (or at the end of the inhalation cycle, depending upon the level of user demand) solenoid member 48 is deactuated to close second air flow path 42. Adjustable contact 66 is adjustably positionable to permit the second preselected pressure level in facepiece 12 to be precisely controlled.

As can be appreciated, second air flow path 42 not only functions to supplement the supply of breathing air provided by first air flow path 26 to decrease inhalation resistance to the user and eliminate negative pressure conditions in the facepiece 12, but it also provides the added safety feature of a parallel air supply which automatically would be actuated in the event that first air flow path 26 failed.

Figure 3:
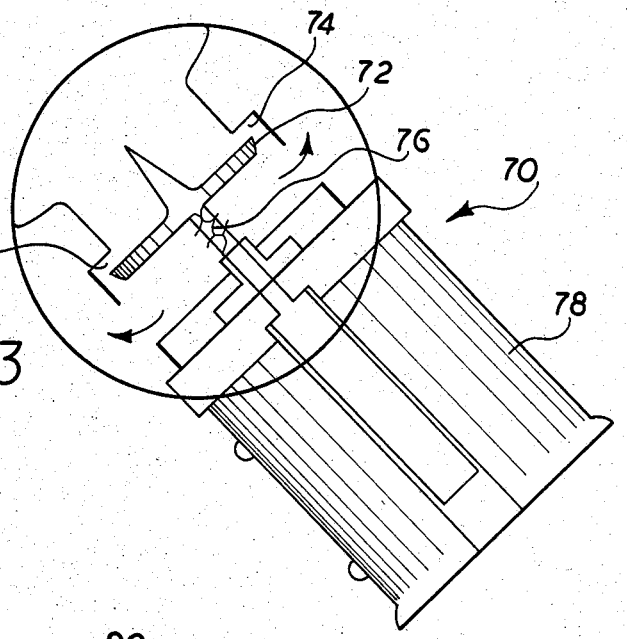
FIG. 3 is an enlarged view of an improved exhalation valve in accordance with the present invention, with portions removed for purposes of clarity.

With reference also to FIG. 3, an improved expiration valve mechanism 70 is provided in facepiece 12, including a valve member 72 positioned to open and close an outlet passage 74 between the interior of facepiece 12 and ambient atmosphere. In the prior art, a lightweight coil spring 76 is positioned to bias valve member 72 toward the closed position. As facepiece pressure increases during an exhalation cycle to a level determined by the tension of spring 76, valve member 72 opens to permit exhaled air to pass into the atmosphere. It has been determined, however, that such a construction is not satisfactory during periods of heavy physical exertion or stress, because excessive positive pressures are generated within facepiece 12 which impose discomforting resistance to expiration.

In accordance with the present invention, there is provided, preferably in conjunction with spring 76, an electromechanical solenoid member 78 connected to open valve member 72 to a degree greater than would otherwise be permitted by the interaction of spring 76 and facepiece pressure. Preferably, solenoid member 78 is actuated to open valve member 72 when facepiece pressure reaches a positive preselected level above which discomfort due to excessive expiration resistance becomes significant, e.g., 2 inches (5.0 cm.) $H_2O$ above atmospheric pressure. When facepiece pressure exceeds this level, valve member 72 is opened to a greater degree to decrease facepiece pressure. As facepiece pressure decreases to below this level, solenoid member 78 is preferably deactuated and the position of valve member 72 is again controlled by the operation of spring 76.

With continued reference to FIG. 2, feedback mechanism 50 is conveniently adapted to control the actuation of solenoid member 78 in response to facepiece pressure. An adjustable contact member 80 is adjustably secured to screen 60 facing the exterior surface of contact member 64. During exhalation, if facepiece pressure exceeds a preselected level, diaphragm 52 moves outwardly to engage contact member 64 the contact member 80, causing the electrical circuit to be completed to actuate solenoid member 78. A subsequent decrease in facepiece pressure below the preselected level disengages the contact members 64 and 80 and deactutes solenoid member 78. The preselected level at which solenoid member 78 is actuated is precisely controllable by adjusting the extension of contact member 80 toward contact member 64.

Thus, it will be appreciated that the expiration valve mechanism of the present invention is responsive to facepiece pressure, but not in a "linear" manner as in known prior art construction. Rather, to be quickly responsive to discomforting increases in facepiece pressure, a threshold facepiece pressure is established beyond which valve member 72 is opened to a greater than linear extent to quickly reduce facepiece pressures to acceptable levels, thereby eliminating expiration resistance during periods of peak physical exertion or stress. Through cooperation with the novel inlet air flow regulator 18 of the present invention, facepiece pressure is maintained throughout the breathing cycle within a relatively narrow range of positive pressures, during periods of both light and heavy demand.

Figure 4:
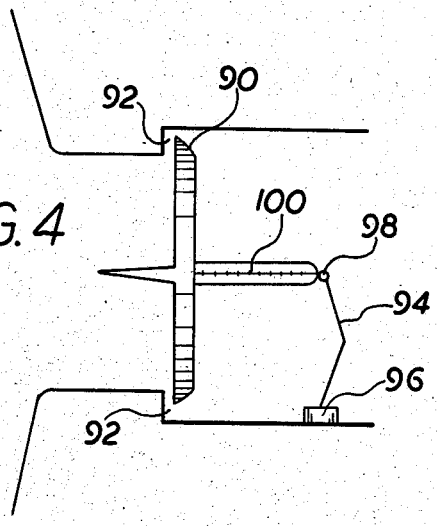
FIG. 4 illustrates a second embodiment of exhalation valve in accordance with the present invention.

With reference now to FIG. 4, a second embodiment of expiration valve mechanism is shown, including an exhaust valve member 90 within an outlet passageway 92, the relative position therebetween being controlled by a nonlinear control spring 94. Control spring 94 is secured at one end within outlet passageway 92 at fixed point 96 and at its other end at pivot point 98 to valve stem 100 of valve member 90.

Figure 5:
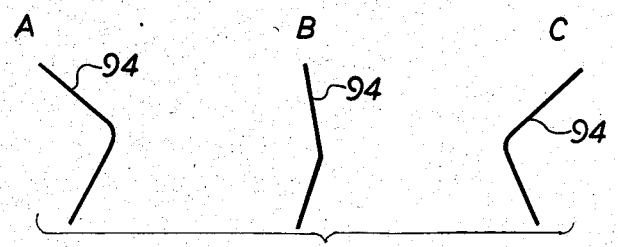
FIGS. 5A, B and C illustrate diagrammatically the operation of the embodiment shown in FIG. 4.

Control spring 94 may be formed of a generally angled length of spring steel or similar material, and is positioned such that it biases valve member 92 into its closed position until facepiece pressure increases during expiration to a first level at which exhaust flow is desired during periods of light demand, e.g., 1.1 inch (2.75 cm.) $H_2O$ above atmospheric. Preferably, as facepiece pressure increases to a second level, e.g., about 2 inches (5.0 cm.) $H_2O$ above atmospheric, control spring 94 responds in a generally linear manner to gradually increase the exhaust passage, control spring 94 itself straightening during such time as shown in FIG. 5B. During heavy expiration, facepiece pressure can be expected to increase to beyond a preselected threshold level, at which pressure control spring 94 snaps beyond a straightened orientation to substantially open valve member 92 in a nonlinear relation to the facepiece pressure. This nonlinear response to facepiece pressure produces a substantially immediate reduction thereof to a level below the preselected threshold, thus returning control spring 94 back into the linear portion of its movement path. In this manner, an upper limit to facepiece pressure is conveniently established which assures that a user will not experience expiratory fatigue during periods of heavy physical exertion or stress.

Figure 6:
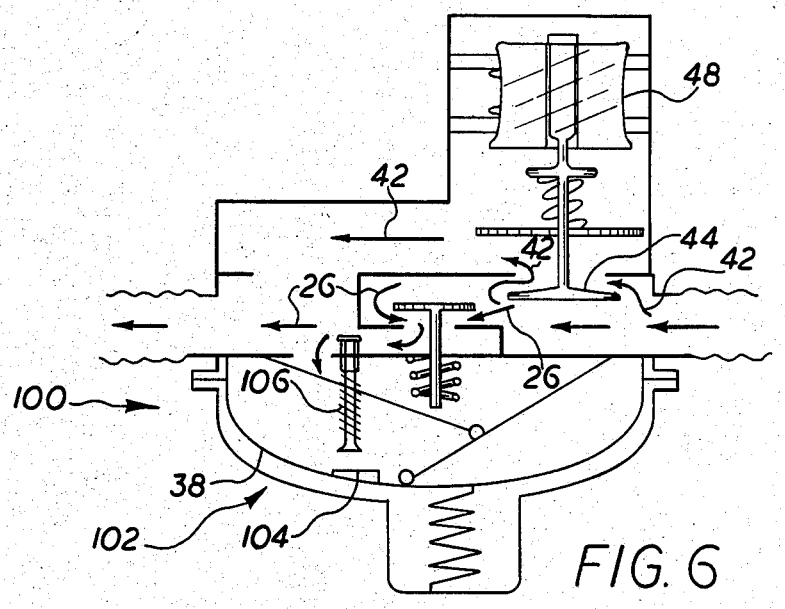
FIG. 6 illustrates a further embodiment of the invention, with portions removed for purposes of clarity.

With reference now to FIG. 6, a second embodiment of an inlet air flow regulator 100 is shown, which may be conveniently used with the expiration valve mechanism shown in FIG. 4. Air flow regulator 100 is similar to air flow regulator 18 of FIG. 1, but includes in addition thereto a feedback mechanism 102 which is responsive to decreases in facepiece pressure during the inhalation cycle and which functions to actuate solenoid member 48 and second valve member 44 to open second air flow path 42. In particular, an electrical contact 104 is positioned on the inner surface of diaphragm 38 facing an adjustable, spring loaded electrical contact 106. An electrical circuit is provided between power source 62, solenoid member 48, electrical contact 104 and electrical contact 106. During an inhalation cycle, facepiece pressure decreases to a first level e.g., 1 inch (2.5 cm.) $H_2O$ above atmospheric, at which point the movement of diaphragm 38 acts to open the first air flow path 26. If facepiece pressure continues to decrease, for example to about 0.5 inch (1.25 cm.) $H_2O$ above atmospheric due to heavy user demands, diaphragm 38 continues to move inwardly until electrical contact 104 engages electrical contact 106 and the electrical circuit is closed to actuate solenoid member 48 and open second air flow path 42. In this manner, a positive pressure is maintained in facepiece 12 during inhalation under both light and heavy user demand conditions to increase safety and reduce respiratory fatigue in the user.

Of course the present invention is not limited to the specific embodiments described in detail herein. Rather, reference must be made to the claims which follow to fully appreciate the scope of the invention.

We claim:

1. A portable, self-contained breathing device of the type which may be used by industry and firefighters to protect a user from toxic atmospheric conditions, comprising:

a facepiece which can be worn on the face of a user to isolate the breathing functions of said user from ambient atmosphere;

a supply of pressurized breathing air to be supplied to said facepiece in response to the inhalation demand of said user;

air flow regulator means between said facepiece and said supply, said regulator means including a first air flow path and second air flow path, said first air flow path including first means to permit air passage from said supply to said facepiece in response to facepiece pressure decreases below a first preselected level, said second air flow path including second means which permits additional air passage from said supply to said facepiece in response to facepiece pressure decreases below a second preselected level lower than said first preselected level; and an electrical power supply;

said first air passage means comprising:

a first valve member, and means hydraulically responsive to changes in pressure in said facepiece caused by the breathing functions of said user to control the opening and closing of said first valve member; and said second air passage means comprising:

a second valve member, pressure-sensitive means responsive to pressure changes in said facepiece, and means for opening said second valve member in response to a signal from said pressure sensitive means that facepiece pressure has decreased below said second preselected level;

wherein said first air flow path is capable of of comfortably providing said user with the volume of breathing air required by said user during light to moderate physical exertion, and said pressure sensitive means is electrically connected to said electrical power supply to generate an electrical signal when said facepiece pressure has decreased below said preselected level.

2. The device as set forth in claim 1, wherein said hydraulic control means comprises:

diaphragm means movably mounted adjacent said first air flow path to respond to changes in pressure in said facepiece, said diaphragm positioned to engage said first valve means during movement thereof.

3. The device as set forth in claim 2, wherein said second air flow path is capable of providing said user with an additional volume of breathing air sufficient to confortably meet requirements of said user during periods of heavy physical exertion.

4. The device as set forth in claim 1:

wherein said opening means comprises an electromechanical solenoid which opens said second valve member in response to said electrical signal from said pressure sensitive means.

5. The device as set forth in claim 4, wherein said pressure sensitive means is mounted within said facepiece.

6. The device as set forth in claim 5 further comprising:

first return spring means mounted to said first valve member to close said first valve member when said facepiece pressure increases above said first preselected level; and second return spring means mounted to said second valve member to close said second valve member when said facepiece pressure increases above said second preselected level.

7. The device as set forth in claim 6, wherein said first preselected level is between about 0.5 inch (1.25 cm.) $H_2O$ and 1.5 inch (3.75 cm.) $H_2O$ above atmospheric pressure.

8. The device as set forth in claim 7, wherein said second preselected level is greater than atmospheric pressure.

9. The device as set forth in claim 8, further comprising:

means for controlling facepiece pressure during an exhalation cycle of said user, said controlling means comprising:

valve means movably positioned to permit communication between said facepiece and ambient atmosphere when said valve means is in an open position and to foreclose communication between said facepiece and ambient atmosphere when said valve means is in a closed position; and means for moving said valve means between said open position and said closed position in response to facepiece pressure, said moving means and said valve means cooperating during said exhalation cycle to maintain said facepiece pressure below a third preselected level greater than said first preselected level and less than about 4 inches (10 cm.) $H_2O$ above ambient pressure, during periods of both light and heavy physical exertion of said user.

10. The device as set forth in claim 9, wherein said moving means comprises:

electrical power supply means;

pressure sensitive means mounted adjacent said facepiece, said pressure sensitive means electrically connected to said electrical power supply means to generate a signal when said facepiece pressure increases to said third preselected level; and electromechanical solenoid means connected to said valve means and electrically connected to said pressure sensitive means to urge said valve means in response to said signal into a sufficiently open position to reduce said facepiece pressure below said third preselected level.

11. In a portable, self-contained breathing device of the type which may be used by industry and firefighters to protect a user from toxic atmospheric conditions, said device comprising a facepiece which can be worn on the face of a user to isolate the breathing functions of said user from ambient atmosphere, and a supply of pressurized breathing air to be supplied to said facepiece in response to the initiation of an inhalation cycle by said user, the improvement comprising:

means for regulating flow of said breathing air to and from said facepiece to maintain pressure within said facepiece at a level greater than ambient pressure and less than 4 inches (10 cm.) $H_2O$ above ambient pressure, throughout the breathing cycle of said user during periods of both light and heavy physical exertion;

said flow regulating means comprising:

inlet regulating means in communication between said air supply and said facepiece, said inlet regulating means including a first air flow path and a second air flow path, said first air flow path including first means to permit air passage from said supply to said facepiece in response to facepiece pressure decreases below a first preselected level, said second air flow path including second means which permits additional air passage from said supply to said facepiece in response to facepiece pressure decreases below a second preselected level lower than said first preselected level, and expiration regulating means in communication between said facepiece and said ambient atmosphere, said expiration regulating means adapted to open communication between said facepiece and said ambient atmosphere when facepiece pressure increases to a third preselected level above said first preselected level during the exhalation cycle of said user, said expiration regulating means including feedback means responsive to facepiece pressure and adapted to control the degree of communication between said facepiece and said ambient atmosphere to maintain said facepiece pressure at a level less than 4 inches (10 cm.) $H_2O$ above ambient atmosphere during periods of both light and heavy exertion of said user, a source of electrical power;

pressure sensitive means mounted in said facepiece and electrically connected to said electrical power source, said pressure sensitive means generating a first signal when facepiece pressure decreases to said second preselected level during an inhalation cycle, and a second signal when said facepiece pressure increases to a fourth preselected level greater than said third preselected level during an exhalation cycle;

first electromechanical solenoid means in said inlet regulating means and responsive to said first signal from said pressure sensitive means to open said second air flow path for the passage of additional air to said facepiece;

spring means in said expiration regulating means adapted to open communication between said facepiece and ambient atmosphere to a first measure in direct hydraulic response to the increase of facepiece pressure above said third preselected level; and second electromechanical solenoid means connected to said expiration regulating means and responsive to said second signal from said pressure sensitive means to further open said communication when facepiece pressure reaches said fourth preselected level.

* * * * *